US005477993A

United States Patent [19]

Maeda

[11] Patent Number: 5,477,993

[45] Date of Patent: Dec. 26, 1995

[54] QUICK COOLING SPRAY

[75] Inventor: Kiyochika Maeda, Tokyo, Japan

[73] Assignee: Sunhayato Co., Ltd., Tokyo, Japan

[21] Appl. No.: 215,620

[22] Filed: Mar. 22, 1994

[30] Foreign Application Priority Data

Jul. 14, 1993 [JP] Japan ..... 5-195467
Nov. 4, 1993 [JP] Japan ..... 5-298894

[51] Int. Cl.[6] ..... B65D 83/14

[52] U.S. Cl. ..... 222/402.13; 361/215

[58] Field of Search ..... 222/402.1, 402.3, 222/402.5, 146.6; 239/390, 391; 361/212, 215, 220

[56] References Cited

U.S. PATENT DOCUMENTS 3,224,645 12/1965 Frost ..... 222/402.13
3,982,157 9/1976 Azuma et al. ..... 361/215
4,819,837 4/1989 Goforth ..... 222/402.1

*Primary Examiner*—Andres Kashnikow
*Assistant Examiner*—Philippe Derakshani
*Attorney, Agent, or Firm*—Evenson, McKeown, Edwards & Lenahan

[57] ABSTRACT

A quick cooling spray wherein a plastic nozzle body in the form of a bottomed cap-shaped has a ceiling plate held in a cantilever manner and a connection portion formed on a bottom surface of the ceiling plate, the connection portion being connected to a stem projecting from a valve housing of a container body, and a plastic nozzle body having an injection nozzle on an outer peripheral wall of the plastic nozzle body being fitted on an upper portion of said container body, further an extension tube connected to the injection nozzle being made of metal and an electrically conductive part which a finger of the operator touches being formed on the plastic nozzle body, and the electrically conductive part and the extension tube being electrically connected to each other.

7 Claims, 4 Drawing Sheets

QUICK COOLING SPRAY

BACKGROUND OF THE INVENTION

1. Field of the Invention

The present invention relates to a spray and more particularly to a quick cooling spray.

2. Description of the Prior Art

Quick cooling sprays have been frequently used in a temperature drift confirmation test or the like for electronic equipments and electronic components such as semiconductors, resistors, capacitors and sensors.

However, when a high pressure gas which is the main component thereof is injected, a strong static electricity is generated within an extension tube connected to an injection nozzle. This is because a large amount of the pressure gas passes through the thin and long extension tube thereby generating a friction resistance. FIG. 7 shows a conventional quick cooling spray in which a strong electricity is generated when the high pressure gas passes through an extension tube C made of resin and connected to an injection nozzle B of a nozzle A.

Also, in particular, freon gas, which is the main content, is now not allowed for use, since CFC-11 and CFC-12 which have been widely used for the gas content damage the ozonosphere. The material to be contained in a spray is changing to HFC-134*a* having an ozonosphere damaging coefficient of zero. However, the HFC 134*a* has a high saturated vapor pressure of 6.8 $Kgf/cm^2$ relative to the CFC-11 and CFC-12, so that static electricity is more liable to occur.

If the gas having a strong static electricity is sprayed to the electronic equipment or component without any treatment, there is a fear that considerable damage would be caused. Therefore, there is a strong demand to well treat the static electricity.

Also, it would be possible to mix static charge preventing agents as one of the methods of treating the static electricity. However, since the static charge preventing agents are expensive, this would be a hindrance for a practical use. In addition, even if the static charge preventing agents are mixed into the content, it would be difficult to effectively prevent the static electricity from occurring because they also have to pass through the long extension tubes made of resin.

SUMMARY OF THE INVENTION

In view of the foregoing defects, an object of the present invention is to provide a spray which is capable of effectively treating static electricity without fail and without using expensive static charge preventing agents.

According to the present invention, there are provided two different structures for two different types of sprays. A first aspect of the invention is drawn to a spray structure in which an injection nozzle body is cap-shaped (i.e., a bottomed cap) and a ceiling plate is of a cantilever type with a connection portion on a bottom surface of the ceiling plate, the connection portion being connected to a stem projection from a valve housing of a container body. The plastic nozzle body is attached to an upper portion of the container body.

In this case, two different types of cap structures may be applicable to the spray. In a first case, an extension tube connected to the injection nozzle is made of metal, and a part which a finger of the user touches, along with the extension tube are made of electrically conductive material for electrical connection therebetween.

In this case, the part which the finger of the user touches may be either the ceiling plate of the nozzle body or the container body itself.

Also, the extension tube made of metal may be coated with an insulating material by, for example, covering it with a resin pipe. Thus, it is possible to prevent frost or water drop from being formed on an outer periphery of the extension tube. Also, it is possible to prevent an accident in a case where the extension tube is accidentally brought into contact with electronic equipments or components during the operation. Furthermore, if the insulating material covering the injection nozzle body somewhat extends from a distal end of the extension tube, it is possible to prevent the end of the extension tube made of metal from accidentally coming into contact with equipment to be subjected to the gas injection.

According to a second aspect of the invention, the extension tube to be connected to the injection nozzle is made of metal, and a metal film layer is formed over the entire surface of the nozzle body made of plastic. In this case, not only is it possible to prevent the generation of the static electricity of the extension tube, but also it is possible to well treat the static electricity generated between the container body and the liquefied gas contained in the container body when the container body is vibrated.

Also, according to the second aspect of the invention, the plastic nozzle body is not in the form of a cap but in the form of a sleeve which is provided with the injection nozzle on its side wall. The sleeve is directly connected to a stem projecting from the valve housing of the container body.

The second aspect is common with the first aspect in that the extension tube connected to the injection nozzle is made of metal. However, in the second aspect of the invention, the metal cap is fitted on the nozzle body.

The following description is directed to a quick cooling spray by way of example. It is however apparent that the invention may be applied to any other type spray for cleaning agents.

The function of the invention will now be described.

In the quick cooling spray according to the first means of the first aspect of the invention, when the user's finger pushes the ceiling plate of the nozzle body, the electricity of the extension tube made of metal will flow through the electrically conductive material to the finger and will be grounded through the body of the user. Also, at the same time, the static charge is also grounded through the container body. Thus, it is possible to remove the static electricity from the gas to be injected from the distal end of the extension tube.

The case where the grounding is effected through the user's body will be described in more detail. As shown in FIGS. 1 and 2, one of the electrically conductive material is connected to the extension tube made of metal, and the other is provided on the ceiling plate of the nozzle body. Accordingly, the static electricity of the extension tube will flow through the user's fingers that grasp the container body to the user's body.

As shown in FIG. 3, the case shere one of the electrically conductive material is connected to the extension tube made of metal, and the other is connected to the container body, the static electricity of the extension tube flow through the user's finger that grasps the container body to the user's body.

As shown in FIGS. 4 and 5, a second aspect of the invention wherein the extension tube to be connected to the injection nozzle is made of metal and a metal film layer is formed over an entire surface of the nozzle body made of plastic allows both static electricity of the extension tube and that of the container body to flow the user's body through the finger pushing the ceiling plate of the nozzle body.

Also, as shown in FIG. 6, in a quick cooling spray in accordance with the second aspect of the invention, when the nozzle body is pushed, the user's finger is brought into contact with the metal cap covering the nozzle body so that the static electricity of the extension tube made of metal will flow through the user's finger to the user's body.

DESCRIPTION OF THE PREFERRED EMBODIMENTS

The present invention will now be described in more detail with reference to the accompanying drawings.

Figure 1:
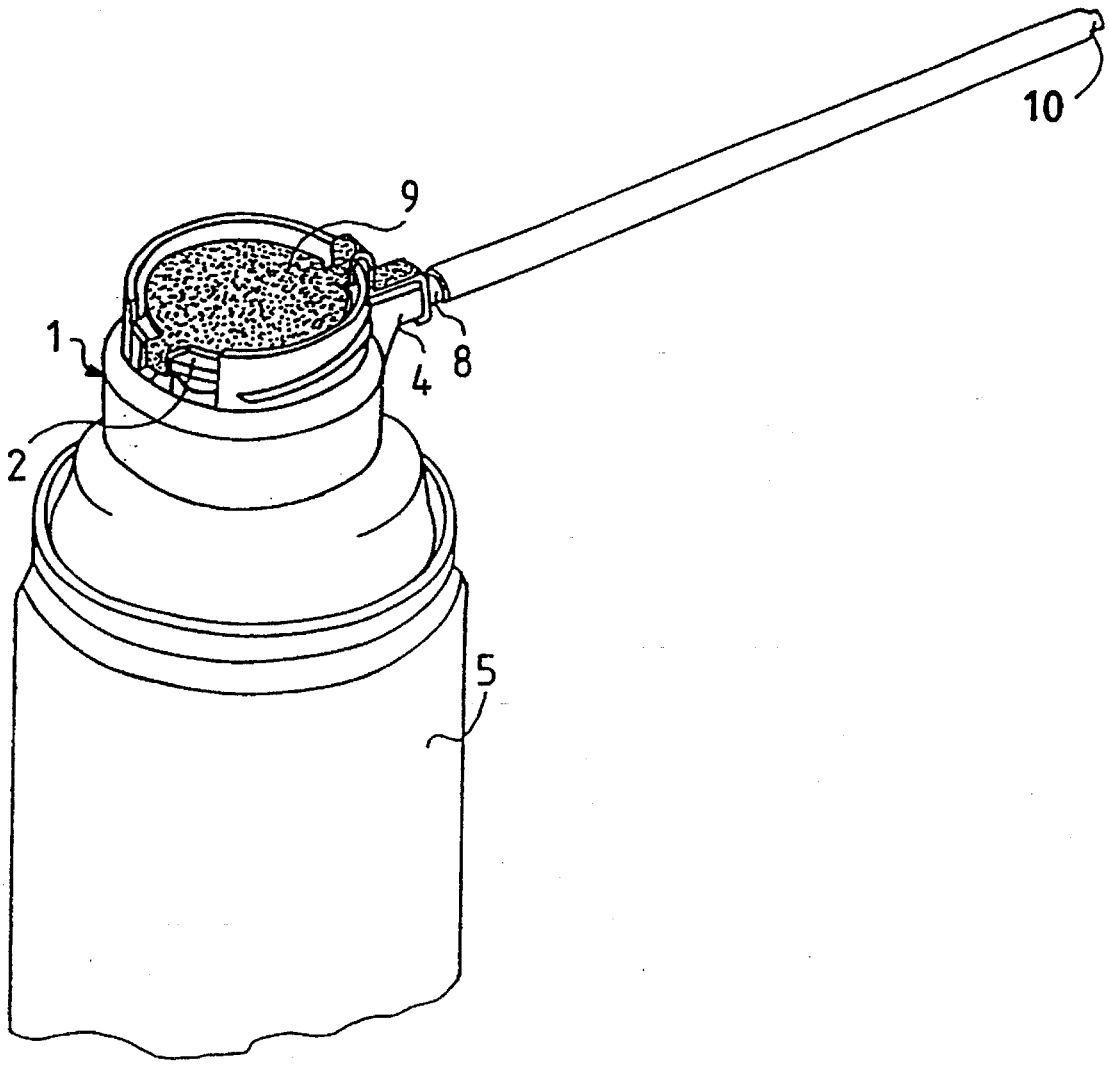
FIG. 1 is a perspective view showing a quick cooling spray in accordance with a first embodiment of a first aspect of the invention.
Figure 2:
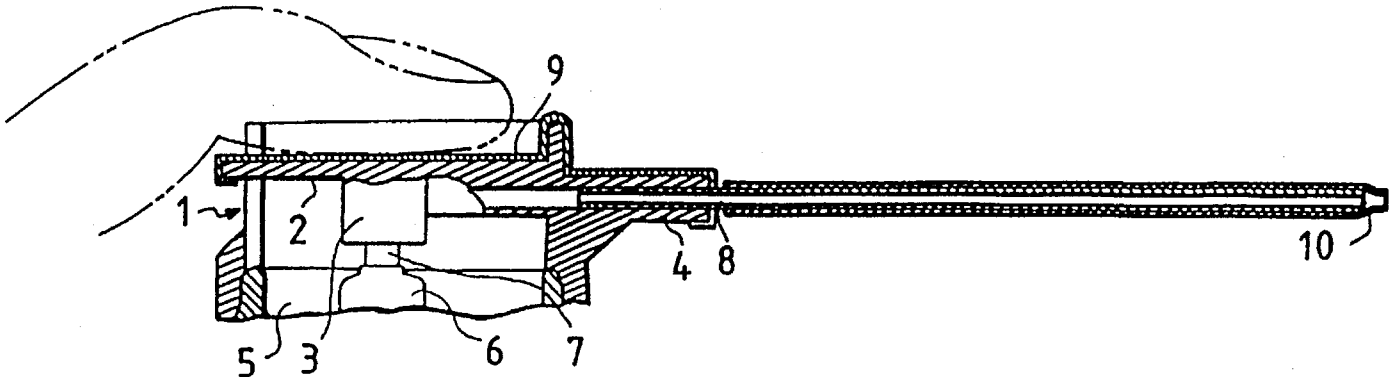
FIG. 2 is an enlarged cross-sectional view showing a,the important part of the spray shown in FIG. 1.

A first embodiment of a first aspect of the invention will now be described with reference to FIGS. 1 and 2. In this embodiment, a nozzle body 1 made of plastic has a cap-shaped configuration (i.e., an inverted bottomed cap) and is formed in a cantilever manner so that a ceiling plate 2 may be moved up and down. A connection portion 3 which projects from a valve housing of a container body 5 is formed on a bottom surface of the ceiling plate 2. An injection nozzle 4 projects from an outer circumferential surface of the nozzle body 1. The plastic nozzle body 1 is fit on an upper portion of the container body 5 to form a quick cooling spray, Incidentally, reference numeral 6 denotes the valve housing formed at the upper portion of the container body 5 and reference numeral 7 denotes a stem for feeding a gas.

In this embodiment, an extension tube 8 connected to the injection nozzle 4 is made of metal instead of resin as in the conventional tube. Also, one end portion of a thin metal plate 9 made of stainless steel or the like is connected to the extension tube 8 and the other end of the plate 9 is located and fixed on a top surface of the ceiling plate 2 of the nozzle body 1. Also, in this embodiment, a top portion of the thin metal plate 9 on the ceiling plate 2 side is in the form of a circular shape in conformity with the shape of the ceiling plate 2. Also, the extension tube 8 is coated with a resin-made pipe 10.

Figure 3:
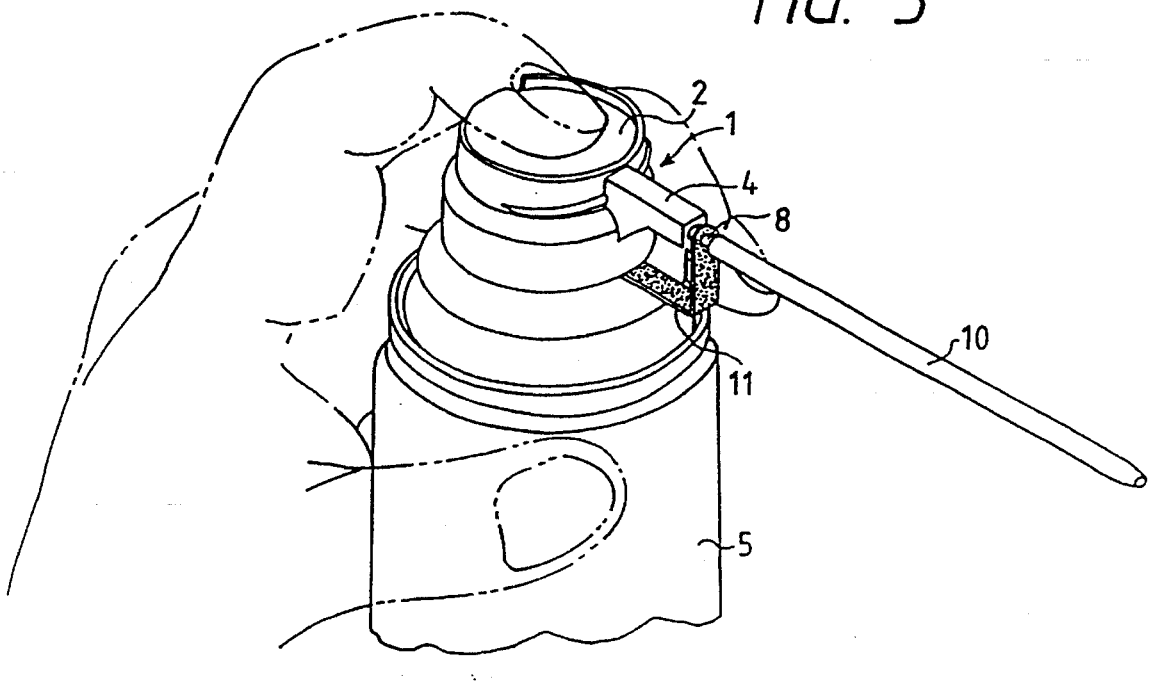
FIG. 3 a perspective view showing a quick cooling spray in accordance with a second embodiment of the first aspect of the invention.

Another embodiment of the first aspect of the invention will now be described with reference to FIG. 3. This embodiment is different from the embodiment shown in FIGS. 1 and 2 in the connection of the thin metal plate. Namely, in this embodiment, the thin metal plate 11 is connected at its one end to the extension tube and at the other end to an upper portion of the container body 5. Incidentally, since the other structure is the same as that shown in FIGS. 1 and 2, the same reference numerals are used for the same components. The explanation therefore will be omitted.

Figure 5:
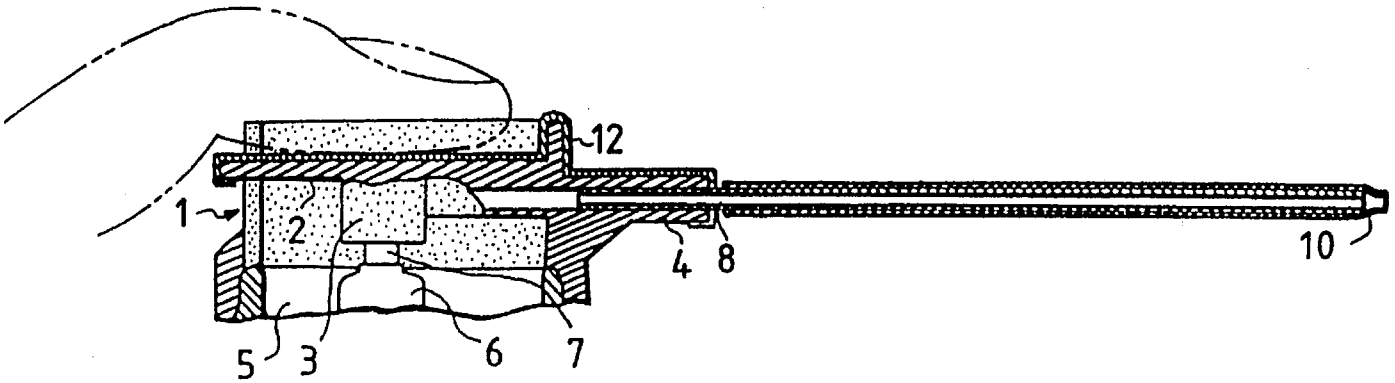
FIG. 5 is an enlarged cross-sectional view showing the important part of the spray shown in FIG. 4.
Figure 4:
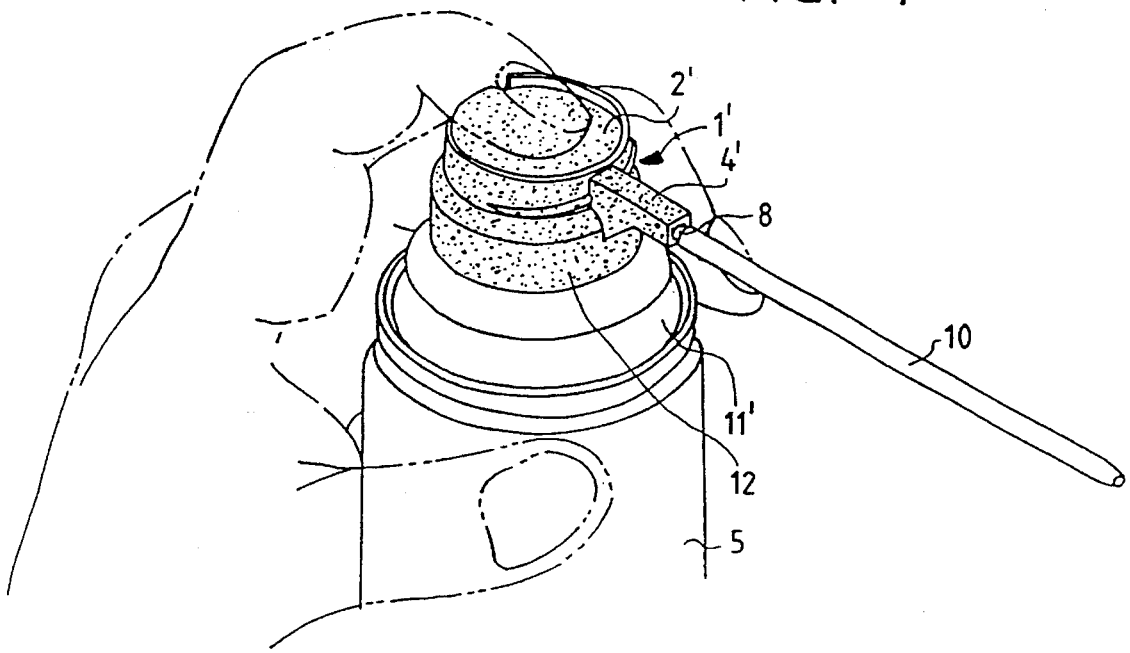
FIG. 4 is a perspective view showing a quick cooling spray in accordance with a third embodiment of the first aspect of the invention.

Another embodiment of the first aspect of the invention will now be described with reference to FIGS. 4 and 5. This embodiment is common with the embodiment shown in FIGS. 1 and 2 in using a metal extension tube 8. The difference between the two embodiments is that in this embodiment a metal film layer 12 is formed over an entire surface of the plastic nozzle body 1 by metal-plating hence the corresponding parts are designated as 1', 2', 4' and 11'.

Figure 6:
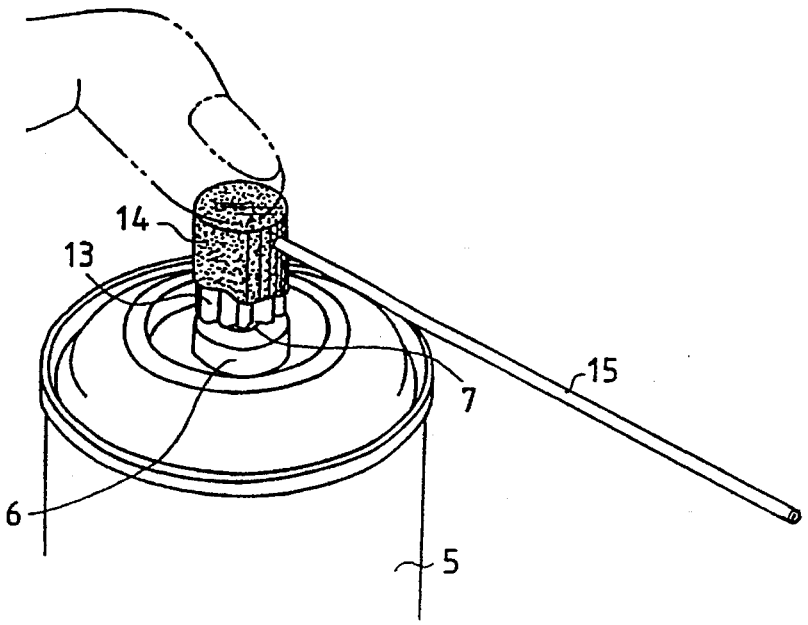
FIG. 6 is a perspective view showing a quick cooling spray in accordance with a second aspect of the invention.
Figure 7:
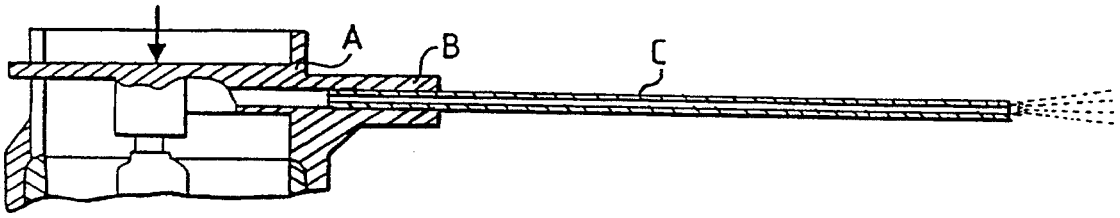
FIG. 7 PRIOR ART
FIG. 7 is an enlarged cross-sectional view showing the important part of a conventional quick cooling spray.

A quick cooling spray in accordance with a second aspect of the invention will be described with reference to FIG. 6. The container body is the same as that shown in FIGS. 1 and 2, and hence the same reference numerals are used to indicate the same components.

In this embodiment, the plastic nozzle body 13 is not in the form of a cap but in the form of a sleeve, and the injection nozzle (not shown) is formed on the side wall of the sleeve-like nozzle body 13. Accordingly, the nozzle body 13 is provided with a metal cap 14 and an extension tube 15 connected to the injection nozzle 13 is made of metal thereby attain the electric connection between the metal cap 14 and the extension tube 15.

Various details of the invention may be changed without departing from its spirit nor its scope. Furthermore, the foregoing description of the embodiments according to the present invention is provided for the purpose of illustration only, and not for the purpose of limiting the invention as defined by the appended claims and their equivalents.

What is claimed is:

1. A quick cooling spray wherein a plastic nozzle body in the form of a bottomed cap-shaped has a ceiling plate held in a cantilever manner and a connection portion formed on a bottom surface of the ceiling plate, said connection portion being connected to a stem projecting from a valve housing of a container body, and said plastic nozzle body having an injection nozzle on an outer peripheral wall, said plastic nozzle body is fitted on an upper portion of said container body, said quick cooling spray comprising the improvement wherein an extension tube connected to said injection nozzle is made of metal, and an electrically conductive part which a finger of the operator touches is formed on said plastic nozzle body, whereby said electrically conductive part and said extension tube are electrically connected to each other.

2. The quick cooling spray according to claim 1, wherein said extension tube is coated with an electrically insulating material.

3. The quick cooling spray according to claim 1, wherein said electrically conductive part is the ceiling plate for the nozzle body.

4. The quick cooling spray according to claim 1, wherein said electrically conductive part is the container body.

5. A quick cooling spray wherein a plastic nozzle body in the form of a bottomed cap-shaped has a ceiling plate held in a cantilever manner and a connection portion formed on a bottom surface of the ceiling plate, said connection portion being connected to a stem projecting from a valve housing of a container body, and said plastic nozzle body having an injection nozzle on an outer peripheral wall of, said plastic nozzle body is fitted on an upper portion of said container body, said quick cooling spray comprising the improvement wherein an extension tube connected to said injection nozzle is made of metal and an entire surface of said plastic nozzle body is formed with a metal film layer.

6. The quick cooling spray according to claim 2, wherein said electrically conductive part is ceiling plate for the nozzle body.

7. The quick cooling spray according to claim 2, wherein said electrically conductive part is the container body.

* * * * *